US011626085B1

(12) United States Patent
Lin et al.

(10) Patent No.: US 11,626,085 B1
(45) Date of Patent: Apr. 11, 2023

(54) COLOR CALIBRATION MODULE AND ELECTRONIC DEVICE INCLUDING SAME

(71) Applicant: ASUSTEK COMPUTER INC., Taipei (TW)

(72) Inventors: Tsui-Wei Lin, Taipei (TW); Tsung-Ju Chiang, Taipei (TW); Yo-Lin Chang, Taipei (TW)

(73) Assignee: ASUSTEK COMPUTER INC., Taipei (TW)

( * ) Notice: Subject to any disclaimer, the term of this patent is extended or adjusted under 35 U.S.C. 154(b) by 0 days.

(21) Appl. No.: 17/834,280

(22) Filed: Jun. 7, 2022

(30) Foreign Application Priority Data

Sep. 27, 2021 (TW) ..... 110135806

(51) Int. Cl.
*G09G 5/02* (2006.01)

(52) U.S. Cl.
CPC ..... *G09G 5/026* (2013.01); *G09G 2320/0261* (2013.01); *G09G 2320/0666* (2013.01); *G09G 2320/0693* (2013.01); *G09G 2360/144* (2013.01)

(58) Field of Classification Search
CPC ..... G09G 5/026
See application file for complete search history.

(56) References Cited

U.S. PATENT DOCUMENTS

2007/0242064 A1* 10/2007 Kuo ..... G09G 3/2003 345/207
2022/0011928 A1* 1/2022 Rowles ..... H04N 5/2256

FOREIGN PATENT DOCUMENTS

CN 110753464 A 2/2020
CN 111540268 A 8/2020
CN 112162624 A 1/2021

* cited by examiner

*Primary Examiner* — Gustavo Polo
(74) *Attorney, Agent, or Firm* — Muncy, Geissler, Olds & Lowe, P.C.

(57) ABSTRACT

A color calibration module applied to an electronic device is provided. The electronic device includes a screen. The screen includes an edge. The color calibration module includes a base and a body. The base is detachably disposed on the edge. The body includes a first end and a second end. The first end is rotatably connected to the base through a rotating shaft, and the second end includes a color calibration detecting head. An electronic device including the color calibration module is further provided.

9 Claims, 10 Drawing Sheets

COLOR CALIBRATION MODULE AND ELECTRONIC DEVICE INCLUDING SAME

CROSS-REFERENCE TO RELATED APPLICATIONS

This application claims the priority benefit of Taiwan application serial No. 110135806, filed on Sep. 27, 2021. The entirety of the above-mentioned patent application is hereby incorporated by reference herein and made a part of the specification.

BACKGROUND OF THE INVENTION

Field of the Invention

The disclosure relates to a color calibration module, and in particular, to a screen color calibration module and an electronic device including the same.

Description of the Related Art

An image worker has a quite high requirement for the accuracy of screen color. To ensure the accuracy of screen color, the color usually needs to be manually calibrated using a color calibrator. Most of conventional color calibrators adopt an external connection design, and are connected to a screen through a connecting wire for operation. The external color calibrator requires a complex installation procedure before use, and is also easy to fall off or be lost.

BRIEF SUMMARY OF THE INVENTION

The disclosure provides a color calibration module applied to an electronic device. The electronic device includes a screen. The screen includes an edge. The color calibration module includes a base and a body. The base is detachably disposed on the edge. The body includes a first end and a second end. The first end is rotatably connected to the base through a rotating shaft, and the second end includes a color calibration detecting head.

The disclosure further provides an electronic device. The electronic device includes a screen and a color calibration module. The screen includes an edge. The color calibration module includes a base and a body. The base is disposed on the edge. The body includes a first end and a second end. The first end is rotatably connected to the base through a rotating shaft. The second end includes a color calibration detecting head.

The color calibration module of the disclosure is disposed on the edge of the screen, and when color calibration is needed, the body of the color calibration module rotates to a front of the screen by using the rotating shaft to perform the color calibration. Therefore, the color calibration module of the disclosure not only facilitates the color calibration procedure, and when the screen is usually used, the color calibration module is also accommodated at the edge of the screen without interfering the image displayed on the screen.

DETAILED DESCRIPTION OF THE EMBODIMENTS

More detailed descriptions of specific embodiments of the disclosure are provided below with reference to the schematic diagrams. The advantages and features of the disclosure are described more clearly according to the following description and claims. It should be noted that all of the drawings use very simplified forms and imprecise proportions, only being used for assisting in conveniently and clearly explaining the objective of the embodiments of the disclosure.

Figure 1:
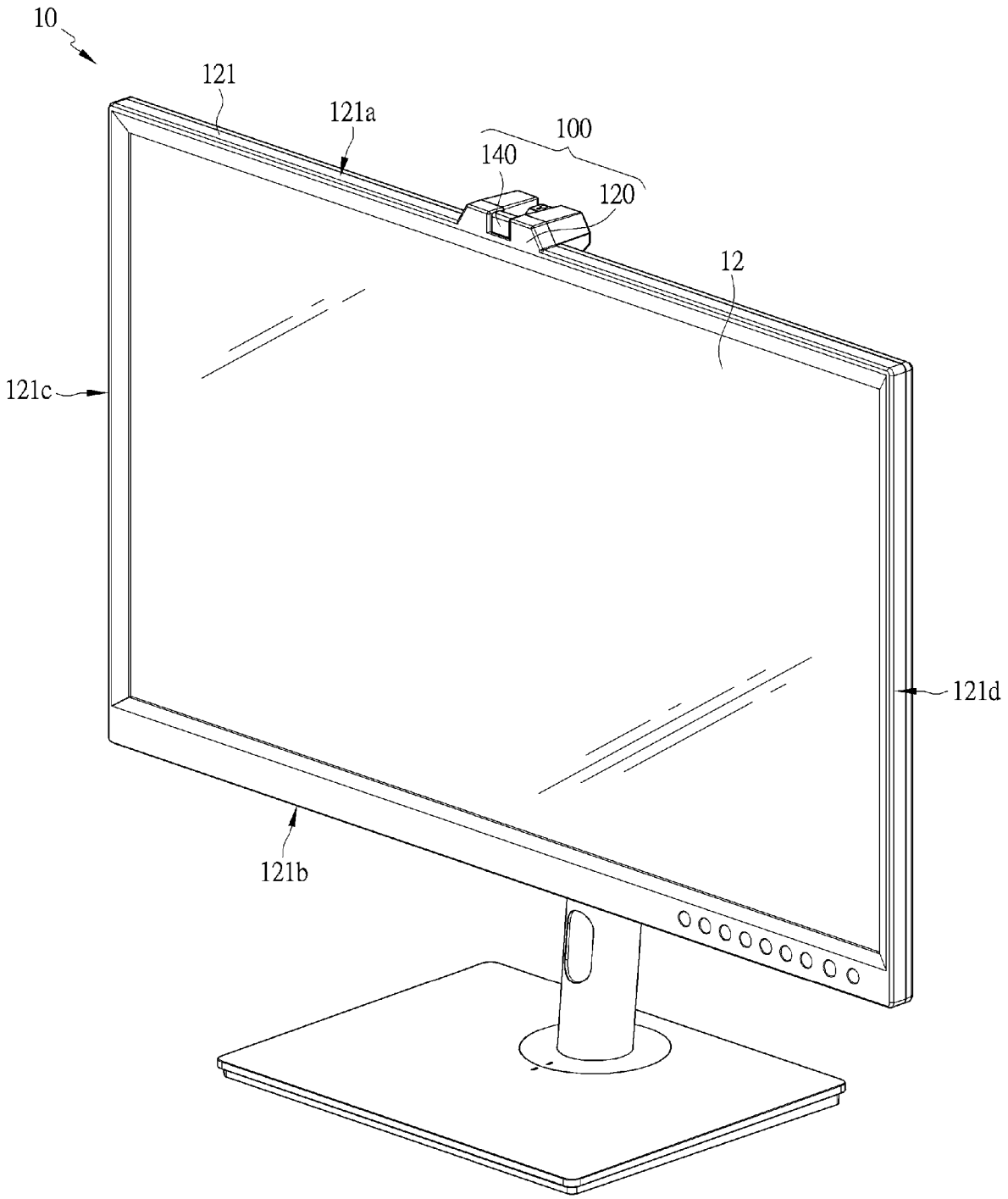
FIG. 1 is a schematic three-dimensional diagram of an embodiment of an electronic device including a color calibration module according to the disclosure.

FIG. 1 is a schematic three-dimensional diagram of an embodiment of an electronic device including a color calibration module according to the disclosure, and the electronic device 10 shown in FIG. 1 is a flat panel display, such as a liquid crystal display or an organic light-emitting diode display. The disclosure is alternatively applied to another electronic device including a color screen.

Referring to FIG. 1, the electronic device 10 of the disclosure includes a screen 12 and a color calibration module 100. The color calibration module 100 is disposed on an edge 121 of the screen 12.

In an embodiment, a base 120 of the color calibration module 100 is disposed in a middle position of an upper edge 121*a* of the screen 12. According to an actual use requirement, the base 120 of the color calibration module 100 is alternatively disposed on a lower edge 121*b*, a left edge 121*c*, or a right edge 121*d* of the screen 12. The color calibration module 100 is alternatively disposed in a position near a corner of the screen, and is not limited to be disposed in a middle position of the edge of the screen 12.

Figure 2:
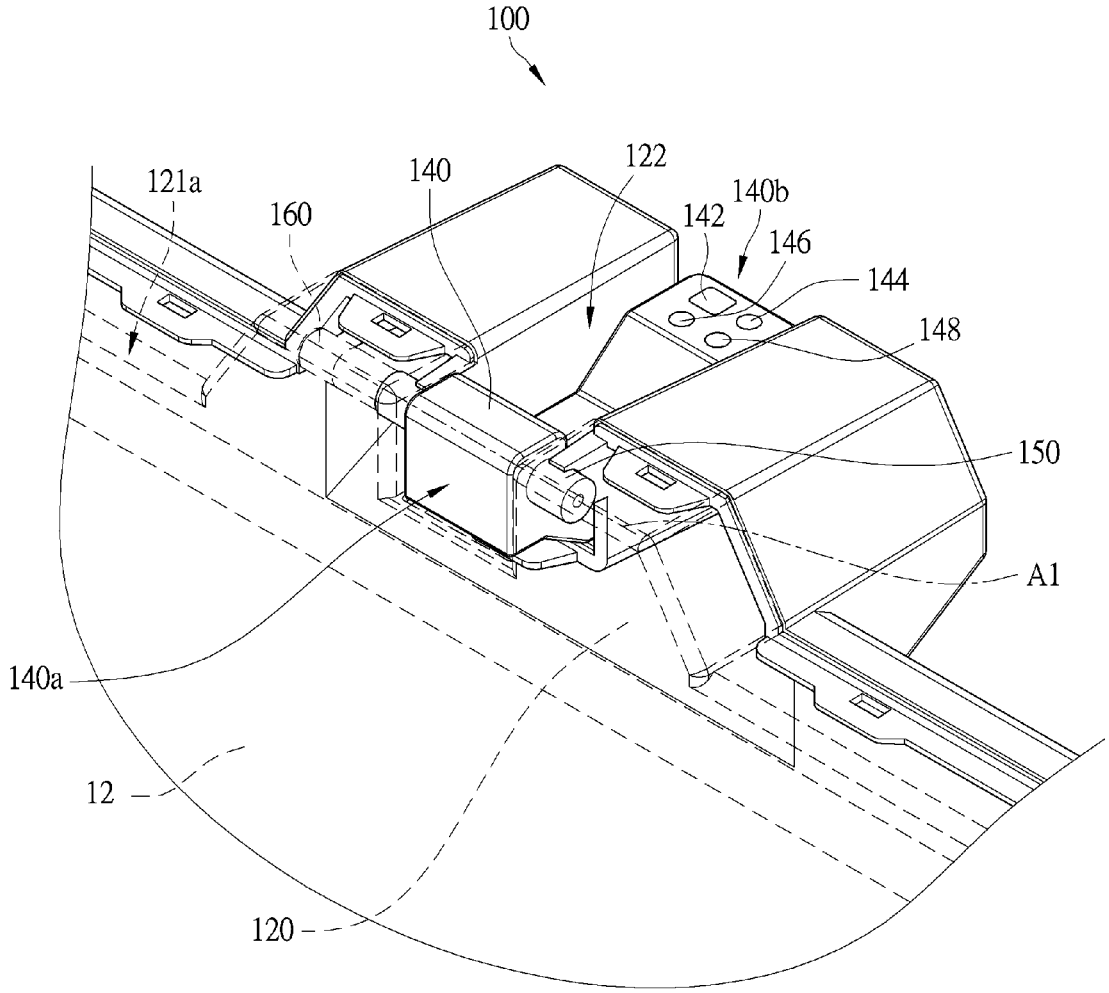
FIG. 2 shows the color calibration module in FIG. 1 on an enlarged scale.
Figure 3:
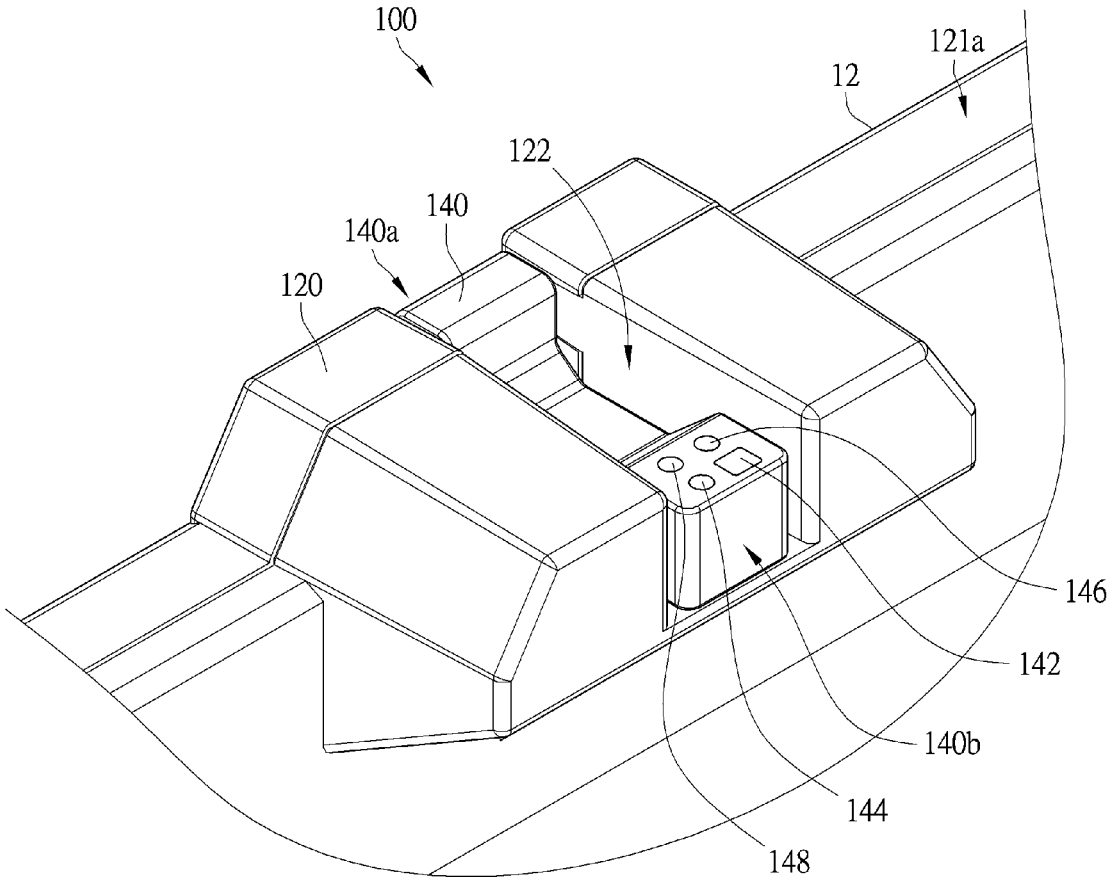
FIG. 3 shows the color calibration module in FIG. 1 from another view angle.

Referring to FIG. 2 and FIG. 3 together, FIG. 2 shows the color calibration module in FIG. 1 on an enlarged scale, and FIG. 3 shows the color calibration module in FIG. 1 from another view angle. FIG. 2 shows internal elements of the color calibration module 100 in a perspective manner. As shown in the figures, the color calibration module 100 includes the base 120 and a body 140.

In an embodiment, the base 120 is disposed on the upper edge 121*a* of the screen 12. The body 140 includes a first end 140*a* and a second end 140*b*. The first end 140*a* is rotatably connected to the base 120 through a rotating shaft 150, and the second end 140*b* includes a color calibration detecting head 142. In an embodiment, an axial direction μl of the rotating shaft 150 is parallel to a display surface of the screen 12, that is, parallel to the upper edge 121*a* of the screen 12.

In an embodiment, the color calibration module 100 further includes a motor 160. The motor 160 is disposed in the base 120 and is connected to the rotating shaft 150, to drive the body 140 to rotate. In an embodiment, the motor 160 is a stepper motor. A user accurately adjusts a rotating angle of the body 140 by using the motor. In another embodiment, an angle position of the body 140 is alternatively manually adjusted by the user.

The second end 140*b* of the body 140 of this embodiment further includes an image pickup element 144, an ambient light detector 146, and a human detector 148, in addition to the color calibration detecting head 142. The image pickup element 144 supports a video function, and the user performs a video conference by using the video function of the image pickup element 144. The ambient light detector 146 detects ambient brightness, and data detected by the ambient light detector is used for adjusting screen brightness. The human detector 148 determines whether there is a user in front of the electronic device 10 or not. In an embodiment, in a case that the human detector 148 detects no user, the electronic device 10 is switched to a standby state, to reduce energy consumption. In an embodiment, the human detector 148 is an infrared detector.

In an embodiment, the color calibration detecting head 142, the image pickup element 144, the ambient light detector 146, and the human detector 148 are located on a same surface of the second end 140*b*, or disposed on different surfaces of the second end 140*b*.

According to the above embodiment, in addition to the color calibration detecting head 142, the image pickup element 144, the ambient light detector 146, and the human detector 148, the body 140 is further provided with other functional elements, such as a microphone, a speaker, and a fill flash, which are added or omitted as needed.

Figure 4:
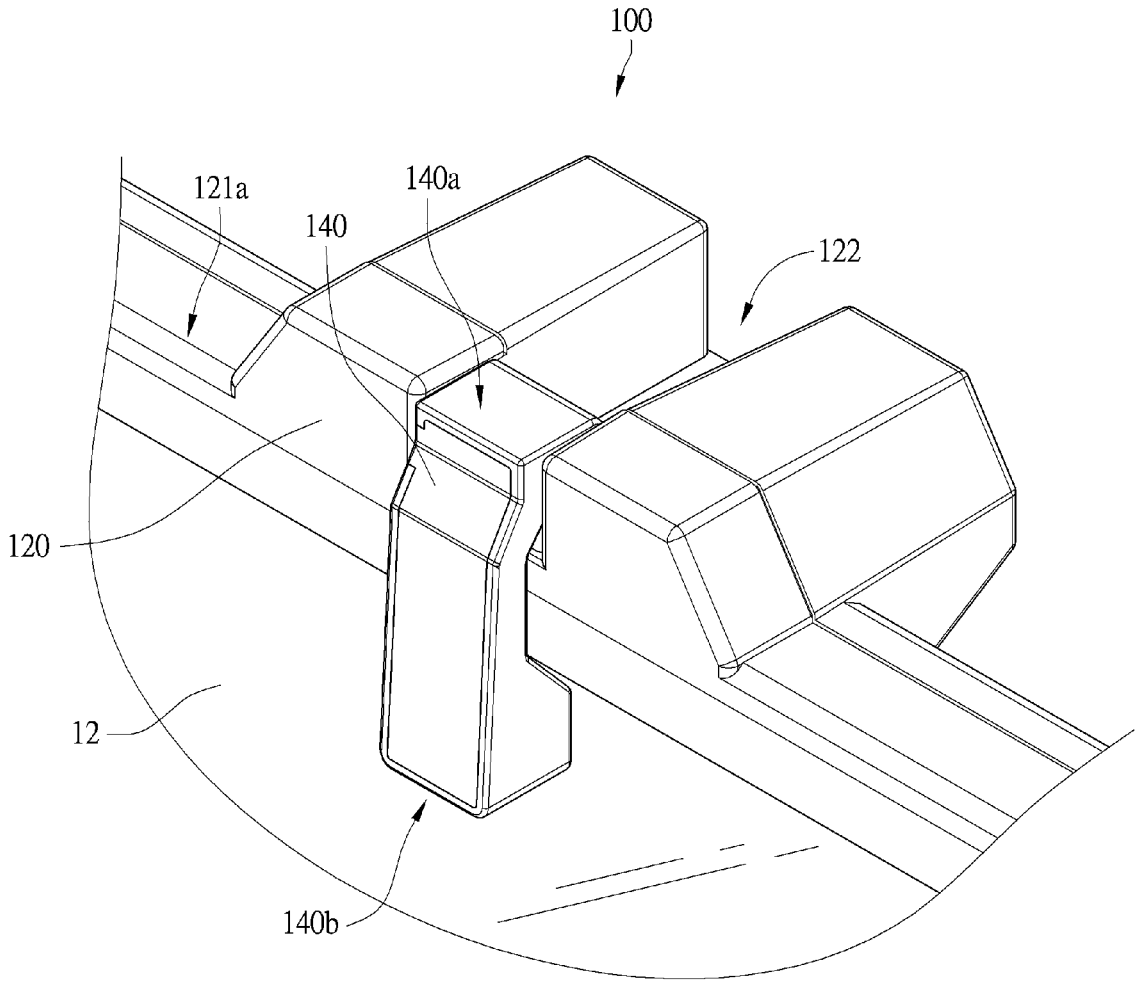
FIG. 4 is a schematic diagram in which a body of the color calibration module moves to a detecting position according to the disclosure.
Figure 5:
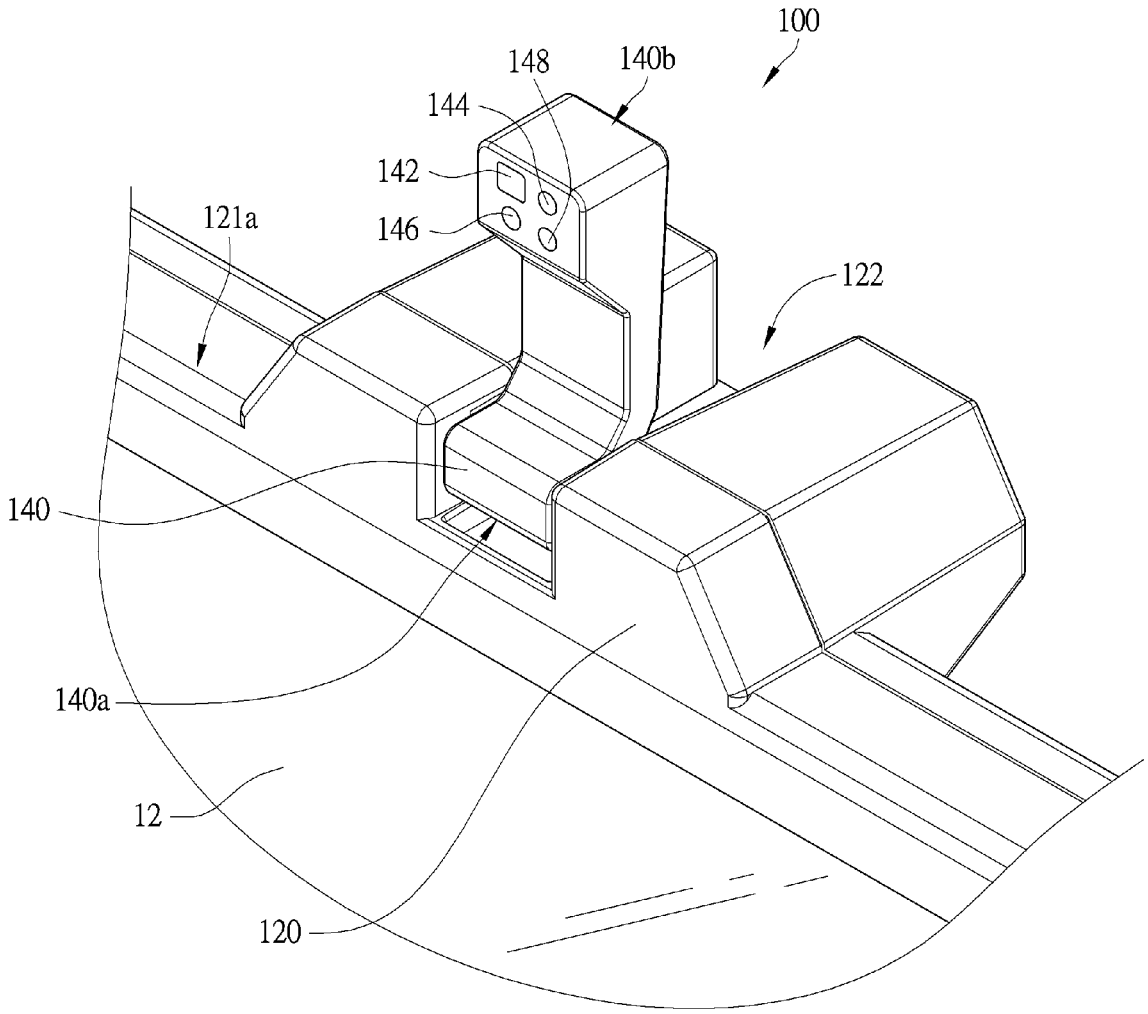
FIG. 5 is a schematic diagram in which the body of the color calibration module moves to a video position according to the disclosure.

Referring to FIG. 2, FIG. 4, and FIG. 5 together, FIG. 4 is a schematic diagram in which the body of the color calibration module moves to a detecting position according to the disclosure, and FIG. 5 is a schematic diagram in which the body of the color calibration module moves to a video position according to the disclosure. The body 140 of the disclosure is driven by the motor 160 to rotate among an accommodating position (which is shown corresponding to FIG. 2), a detecting position (which is shown corresponding to FIG. 4), and a video position (which is shown corresponding to FIG. 5).

Referring to FIG. 2, the base 120 of the color calibration module 100 includes an accommodating slot 122, and the rotating shaft 150 is located on one end of the accommodating slot 122. When the body 140 is located in the accommodating position, the body 140 is located in the accommodating slot 122.

In an embodiment, a volume size of the accommodating slot 122 corresponds to a volume size of the body 140, and an extension direction of the accommodating slot 122 is perpendicular to the axial direction μl of the rotating shaft 150. In this way, the body 140 is completely accommodated in the accommodating slot 122.

Referring to FIG. 4, if color calibration for the screen 12 is needed, the motor 160 is used to drive the body 140 to rotate toward a front of the screen 12 from the accommodating position shown in FIG. 2 to the detecting position shown in FIG. 4. In an embodiment, the body 140 rotates from the accommodating position to the detecting position at a rotating angle from 260 to 270 degrees.

When the body 140 is located in the detecting position, the color calibration detecting head 142 disposed on the second end 140*b* is toward a display area of the screen 12, and the color calibration detecting head 142 is configured to detect a color displayed in the display area, to perform screen color calibration. A procedure of the screen color calibration is well known in the art and is not the technical point of the disclosure. Therefore, details are not described herein.

Referring to FIG. 5, the image pickup element 144 uses the motor 160 to drive the body 140 to rotate toward the front of the screen 12 from the accommodating position shown in FIG. 2 to the video position shown in FIG. 5.

In an embodiment, the body 140 rotates from the accommodating position to the video position at a rotating angle from 80 to 90 degrees. When the body 140 is located in the video position, the color calibration detecting head 142, the image pickup element 144, the ambient light detector 146, and the human detector 148 are all toward the front of the screen 12. In this way, when the color calibration module 100 of the disclosure is used to perform the video conference, the ambient light detector 146 is also used to detect the ambient brightness to determine whether there is a need to fill light or adjust image brightness, and the human detector 148 is also used to determine whether the user leaves and the video function needs to be stopped or not.

The color calibration module 100 of the disclosure is used by being integrated in the electronic device 10, or used with a variety of electronic devices as an independent product, and details are made as follows.

Figure 6A:
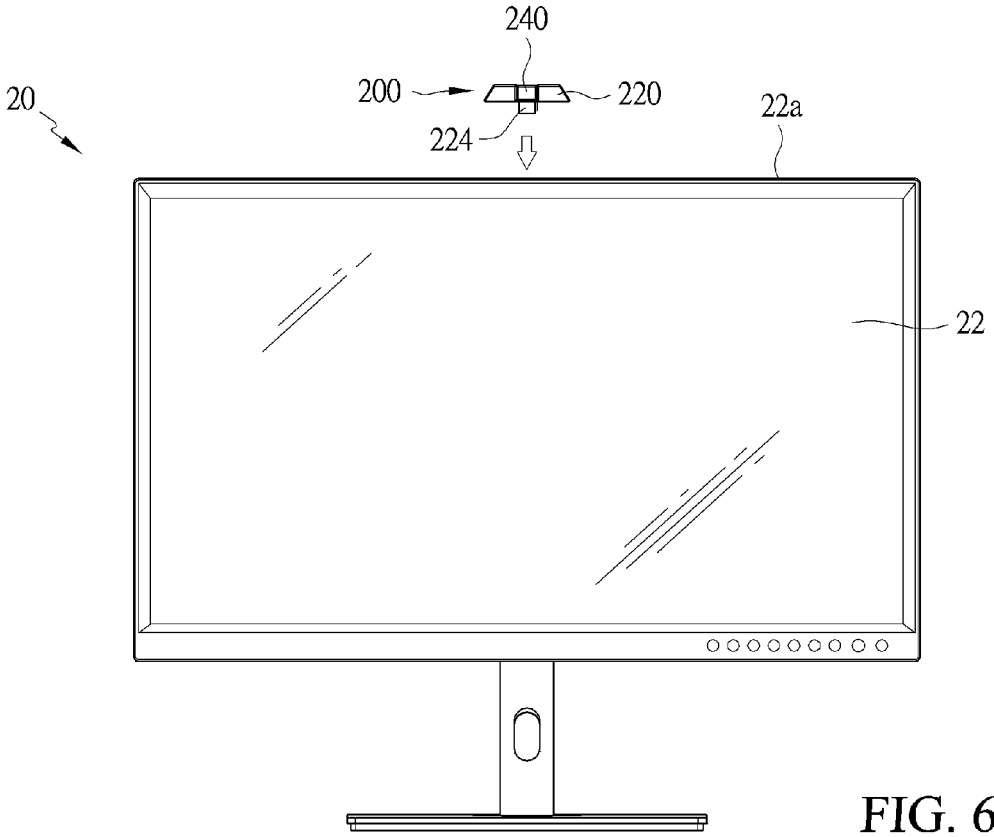
FIG. 6A and FIG. 6B are schematic diagrams in which a color calibration module is installed on a display for use according to the disclosure.
Figure 6B:
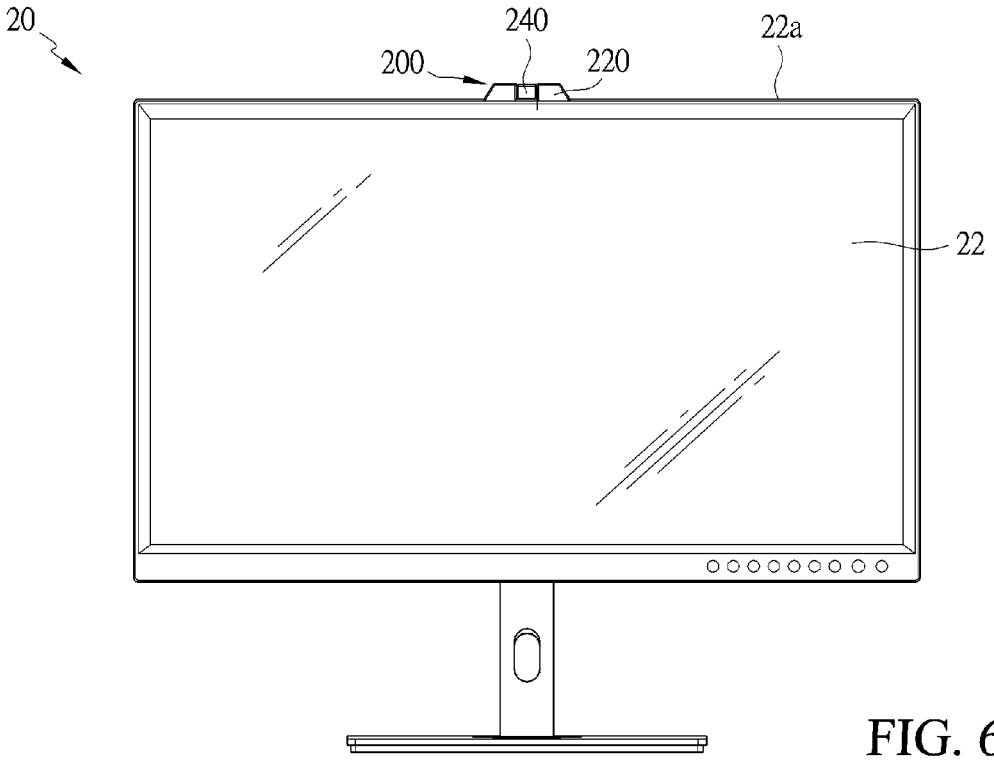

FIG. 6A and FIG. 6B are schematic diagrams in which a color calibration module is installed on a display 20 for use according to the disclosure. An arrow in FIG. 6A represents an installation direction in which the color calibration module 200 is installed on the display 20.

As shown in the figures, the color calibration module 200 includes a base 220 and a body 240. There is a connector 224 below the base 220. An upper edge 22*a* of a screen 22 includes a slot (not shown in the figures) corresponding to the connector 224. The base 220 is detachably inserted to the slot through the connector 224. In this way, the base 220 is disposed on the upper edge 22*a* of the screen 22 of the display 20, and is electrically connected to the display 20 through the connector 224 and the slot. In an embodiment, the connector 224 is a universal serial port connector. The main difference between the color calibration module 200 and the color calibration module 100 shown in FIG. 2 lies in the part of the base 220, and other structure details of the color calibration module 200 are similar to the color calibration module 100 shown in FIG. 2, and are not described herein.

In an embodiment, the color calibration module 200 takes power through the connector 224. In another embodiment, the color calibration module 200 takes power by connecting another power line to an outside power supply, or a battery is installed inside the color calibration module 200 to supply power required for operation.

In this embodiment, the color calibration module 200 is electrically connected to the display 20 through the connector 224 to perform a color calibration procedure.

Figure 6C:
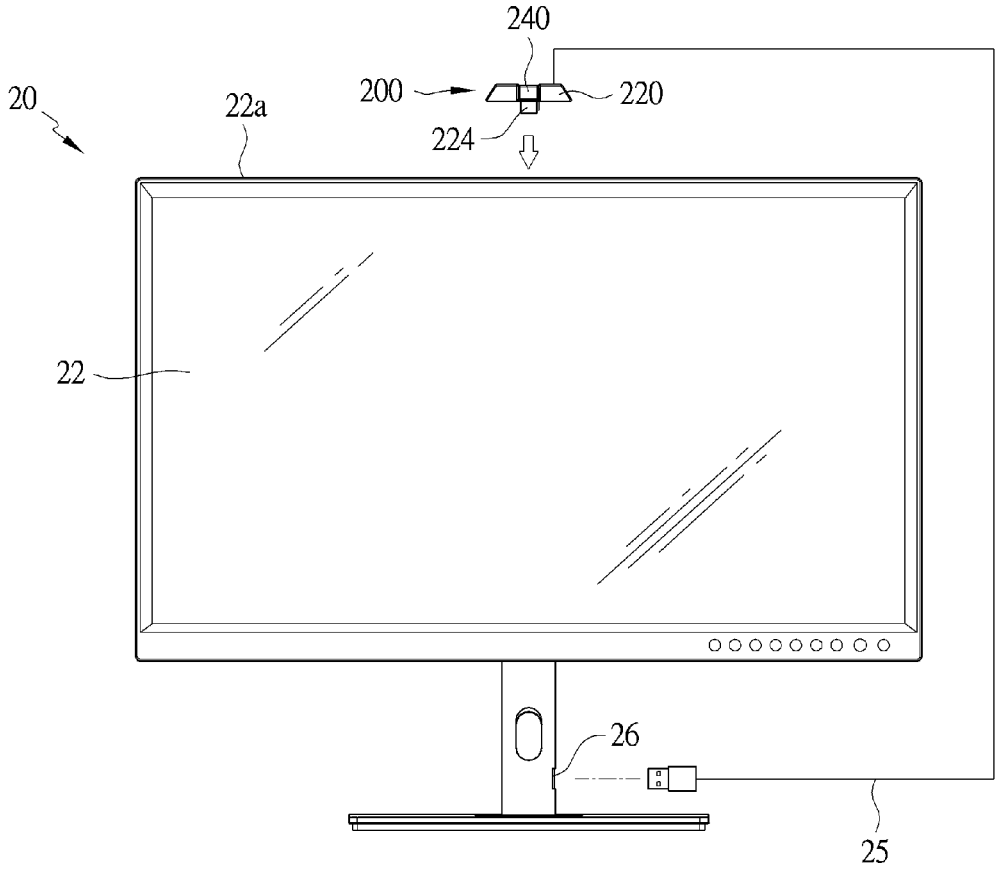
FIG. 6C is a schematic diagram of another embodiment in which the color calibration module is installed on the display for use according to the disclosure.

FIG. 6C is a schematic diagram of another embodiment in which the color calibration module is installed on the display 20 for use according to the disclosure. Compared with the embodiment of FIG. 6B, the color calibration module 200 of this embodiment is detachably fixed to the upper edge 22*a* of the screen 22 through the connector 224, and is further connected to a connecting port 26 on the base of the display 20 through a connecting wire 25, to electrically connect the color calibration module 200 to the display 20.

The color calibration module 200 is electrically connected to the display 20 in an entity connecting manner in the foregoing embodiments. In another embodiment, the color calibration module 200 is electrically connected to the display 20 in a wireless manner.

Figure 7A:
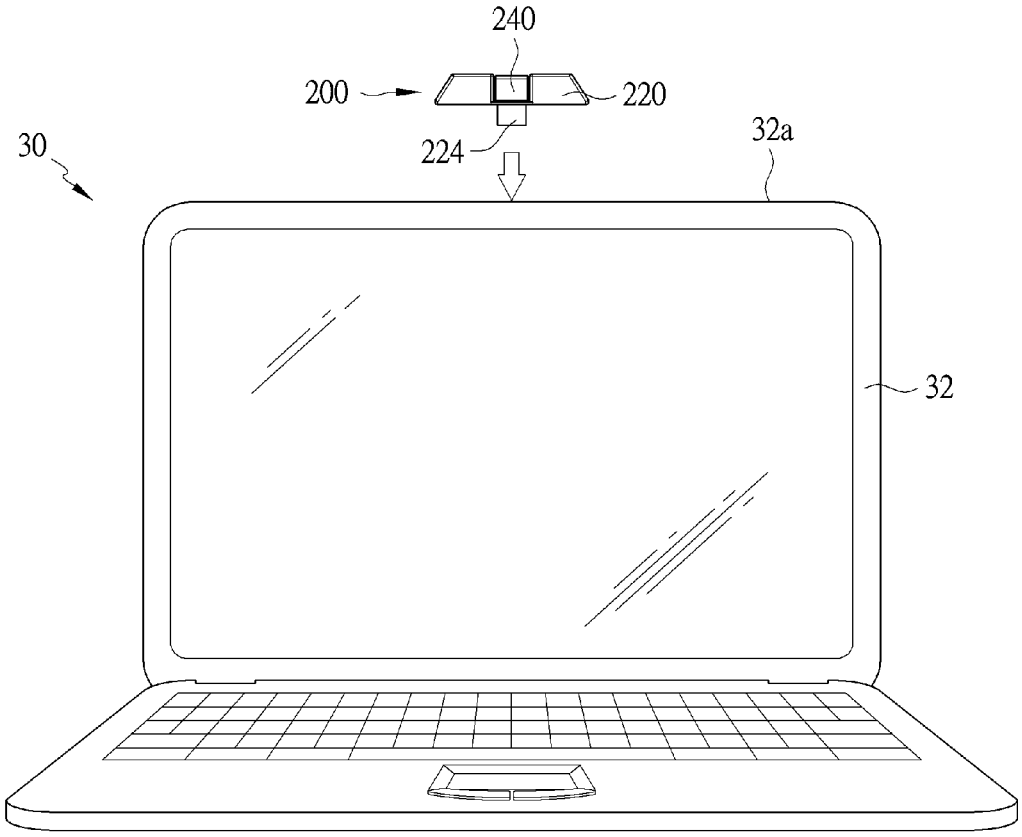
FIG. 7A and FIG. 7B are schematic diagrams in which the color calibration module is installed on a notebook computer for use according to the disclosure.
Figure 7B:
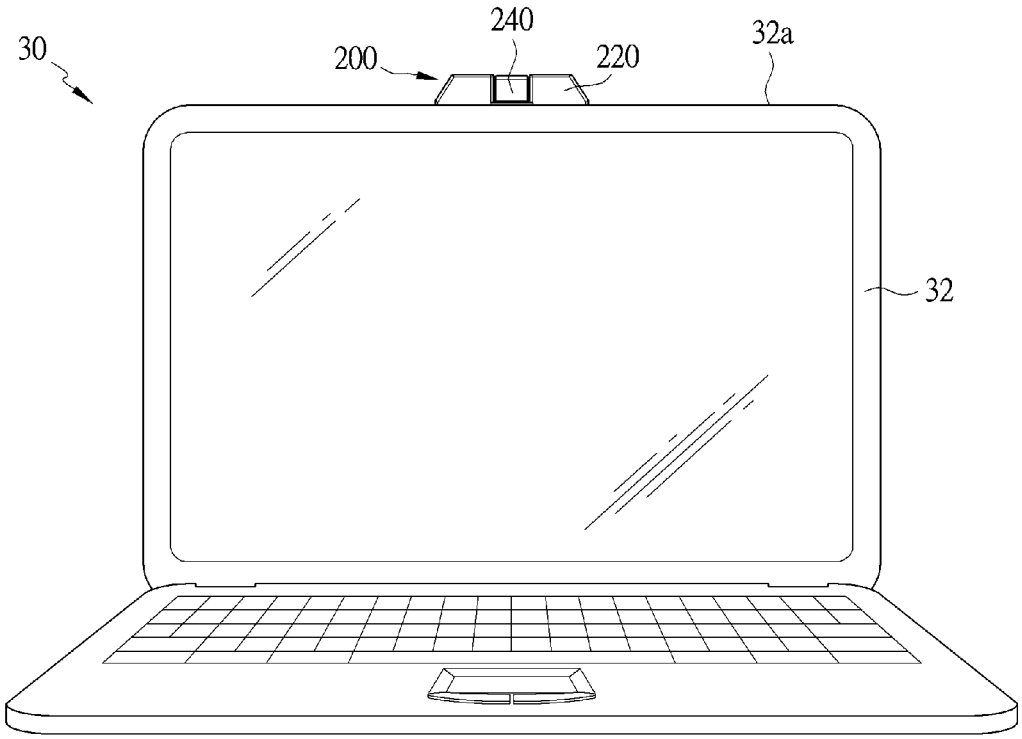

FIG. 7A and FIG. 7B are schematic diagrams in which the color calibration module is installed on a notebook computer 30 for use according to the disclosure. An arrow in FIG. 7A represents an installation direction in which the color calibration module 200 is installed on the notebook computer 30.

As shown in the figures, an upper edge 32*a* of a screen part 32 of the notebook computer 30 includes a slot (not shown in the figures) corresponding to the connector 224. The base 220 of the color calibration module 200 is detachably disposed on the upper edge 32*a* of the screen part 32 of the notebook computer 30 through the connector 224, and is electrically connected to the notebook computer 30 through the connector 224 and the slot. In an embodiment, the connector 224 is a universal serial port connector.

Figure 7C:
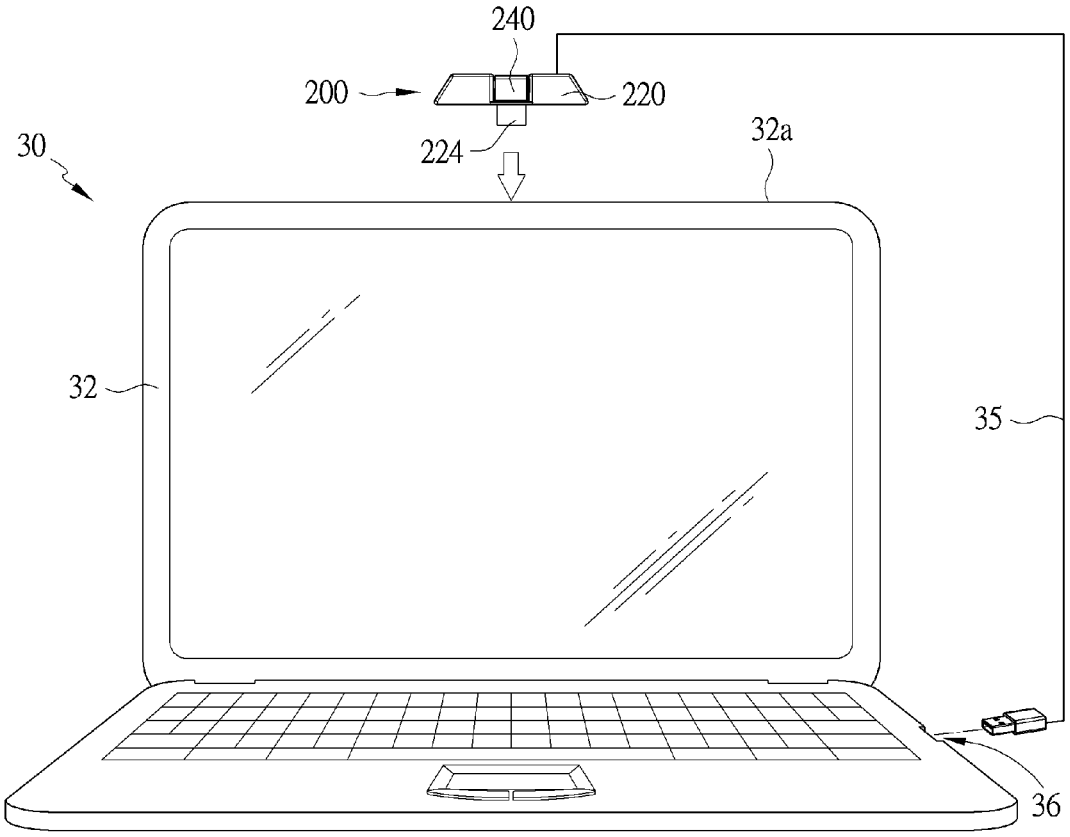
FIG. 7C is a schematic diagram of another embodiment in which the color calibration module is installed on the notebook computer for use according to the disclosure.

FIG. 7C is a schematic diagram of another embodiment in which the color calibration module is installed on the notebook computer 30 for use according to the disclosure. Compared with the embodiment of FIG. 7B, the color calibration module 200 of this embodiment is detachably fixed to the upper edge 32*a* of the screen part 32 of the notebook computer 30 through the connector 224, and is further connected to a connecting port 36 of a host part of the notebook computer 30 through a connecting wire 35, to electrically connect the color calibration module 200 to the notebook computer 30.

Figure 8A:
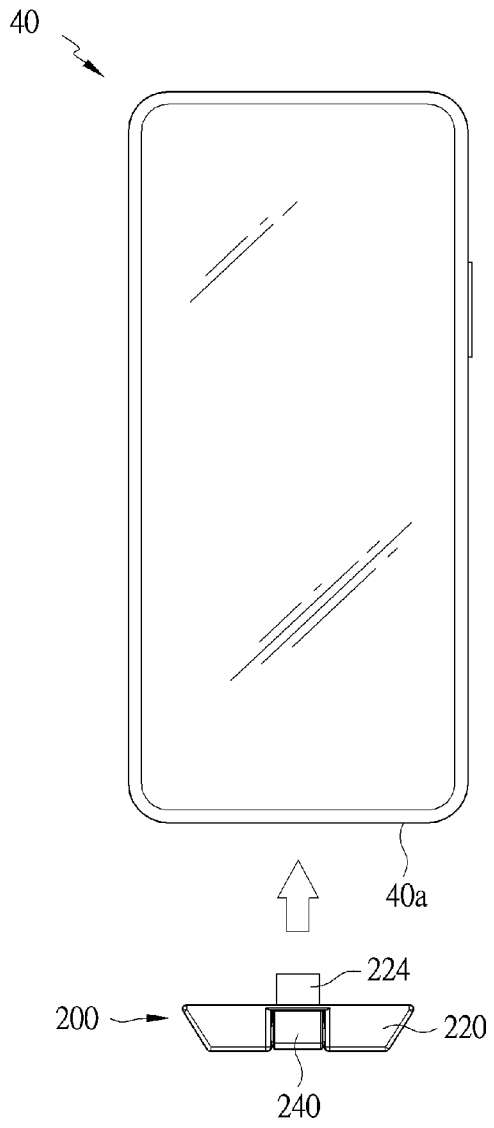
FIG. 8A and FIG. 8B are schematic diagrams in which the color calibration module is installed on a smartphone for use according to the disclosure.
Figure 8B:
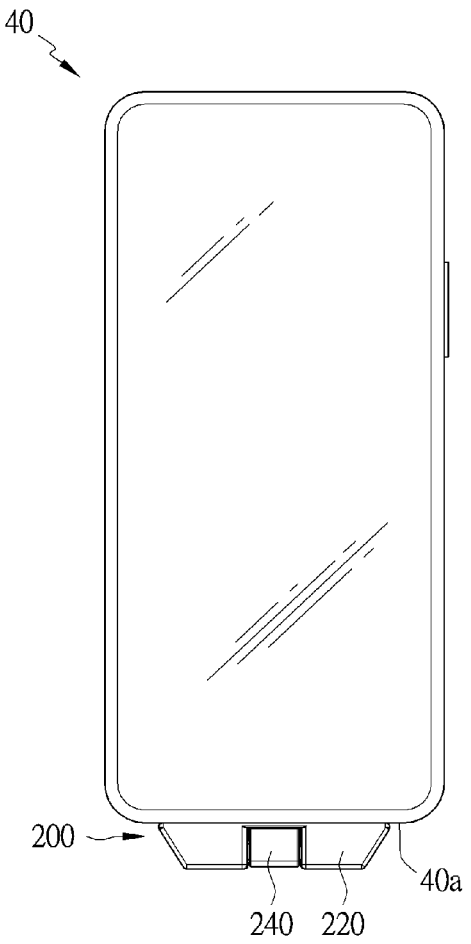

FIG. 8A and FIG. 8B are schematic diagrams in which the color calibration module is installed on a smartphone 40 for use according to the disclosure. An arrow in FIG. 8A represents an installation direction in which the color calibration module 200 is installed on the smartphone 40.

As shown in the figures, by matching a disposing position of a connector slot on the smartphone 40, the base 220 of the color calibration module 200 is detachably disposed on a lower edge 40*a* of the smartphone 40 through the connector 224. In an embodiment, the connector 224 is a universal serial port Type-C connector.

In conclusion, the color calibration modules 100 and 200 of the disclosure match the connector slot and are disposed on the edge of the screen or of a screen part of another electronic device, when color calibration is needed, the bodies 140 and 240 rotate to the front of the screen by using the rotating shaft 150 to perform the color calibration, and are usually accommodated at the edge of the screen, to avoid interfering the image displayed on the screen. In addition, the bodies 140 and 240 of the disclosure are provided with detection elements such as the image pickup element 144, the ambient light detector 146 and the human detector 148, rotate by using the rotating shaft 150, and provide other operation functions in addition to the color calibration, to meet requirements of the user.

The above are merely preferred embodiments of the disclosure, and do not constitute any limitation on the disclosure. Any form of equivalent replacements or modifications to the technical means and technical content disclosed in the disclosure made by a person skilled in the art without departing from the scope of the technical means of the disclosure still fall within the content of the technical means of the disclosure and the protection scope of the disclosure.

What is claimed is:

1. A color calibration module, adapted to be electrically connected to an electronic device, wherein the electronic device comprises a screen, the screen comprises an edge, and the color calibration module comprises:

a base, detachably disposed on the edge; and a body, comprising a first end and a second end, wherein the first end is rotatably connected to the base through a rotating shaft, and the second end comprises a color calibration detecting head, wherein the body rotates between a detecting position and an accommodating position by using the rotating shaft, and when the body rotates to the detecting position, the color calibration detecting head is toward a display area of the screen.

2. The color calibration module according to claim 1, further comprising a motor, disposed in the base and connected to the rotating shaft, to drive the body to rotate.

3. The color calibration module according to claim 1, wherein the base comprises an accommodating slot, and when the body rotates to the accommodating position, the body is located in the accommodating slot.

4. The color calibration module according to claim 1, wherein there is a video position between the detecting position and the accommodating position, and when the body rotates to the video position, the color calibration detecting head is toward a front of the screen.

5. The color calibration module according to claim 1, wherein the second end further comprises an image pickup element.

6. The color calibration module according to claim 1, wherein the second end further comprises an ambient light detector.

7. The color calibration module according to claim 1, wherein the second end further comprises a human detector.

8. The color calibration module according to claim 1, wherein the base further comprises a connector, and is electrically connected to a connector slot of the electronic device through the connector.

9. An electronic device, comprising:

a screen, comprising an edge; and a color calibration module, comprising;

a base, disposed on the edge; and a body, comprising a first end and a second end, wherein the first end is rotatably connected to the base through a rotating shaft, and the second end comprises a color calibration detecting head, wherein the body rotates between a detecting position and an accommodating position by using the rotating shaft, and when the body rotates to the detecting position, the color calibration detecting head is toward a display area of the screen.

* * * * *